United States Patent [19]

Buchner

[11] Patent Number: 4,858,207

[45] Date of Patent: Aug. 15, 1989

[54] ALARM DEVICES

[75] Inventor: Albrecht Buchner, Central, Hong Kong

[73] Assignee: Micro Technologies International Limited, Hong Kong

[21] Appl. No.: 164,388

[22] Filed: Mar. 4, 1988

[30] Foreign Application Priority Data

Mar. 6, 1987 [GB] United Kingdom ..... 8705278
Mar. 11, 1987 [TW] Taiwan ..... 76101358

[51] Int. Cl.[4] ..... G04B 47/00; B65D 8/304

[52] U.S. Cl. ..... 368/10; 368/109; 206/534

[58] Field of Search ..... 368/10, 107–109, 368/113; 206/534; 221/2, 3, 9

[56] References Cited

U.S. PATENT DOCUMENTS

| | | | |
|---|---|---|---|
| 2,845,831 | 8/1958 | Hammond | 200/5 E |
| 4,526,474 | 7/1985 | Simon | 368/10 |
| 4,660,991 | 4/1987 | Simon | 368/10 |
| 4,700,586 | 10/1987 | Miura | 200/5 E |

*Primary Examiner*—Vit W. Miska
*Attorney, Agent, or Firm*—Wood, Herron & Evans

[57] ABSTRACT

An alarm device which will remind the user to take individually packaged medicaments such as contraceptive pills at the correct time. The device has a support for the package and individually depressible buttons, each aligned with one individual compartment of the packet. In this way depression of a button will get an individually packed pill. Timer means are provided for monitoring the time lapsed after any button has been depressed and means link the button to the timer means so that depression of any one button will re-start the timer means. An audible alarm is provided which sounds when the timer means reach a preselected time.

6 Claims, 4 Drawing Sheets

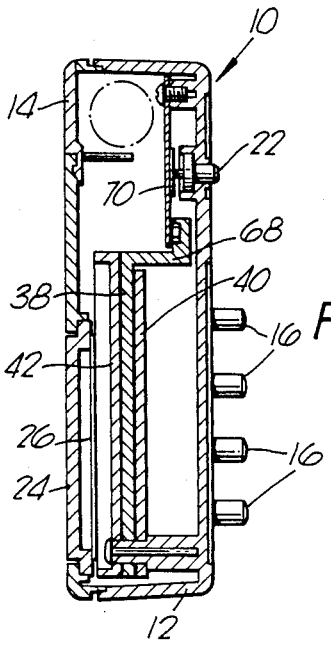
Fig. 3.
Fig. 4.
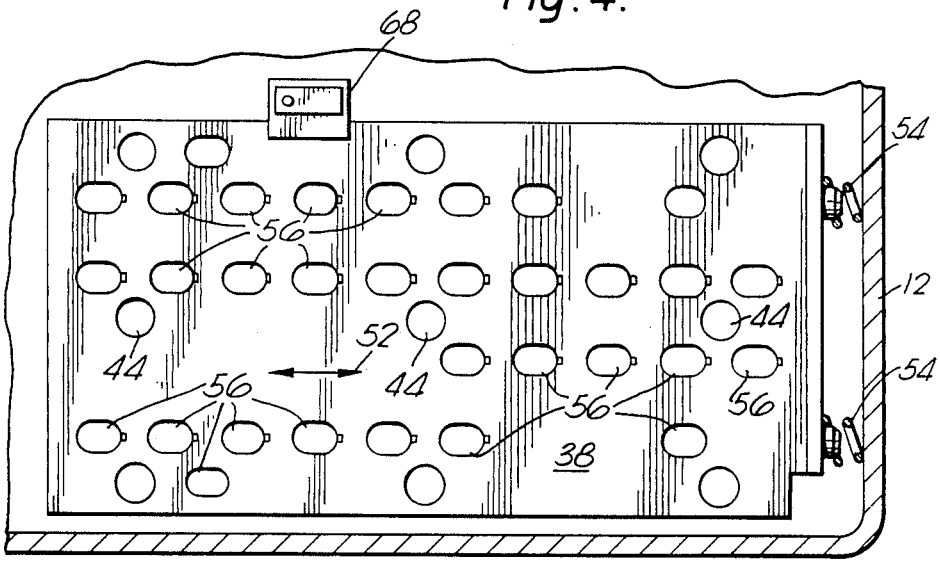

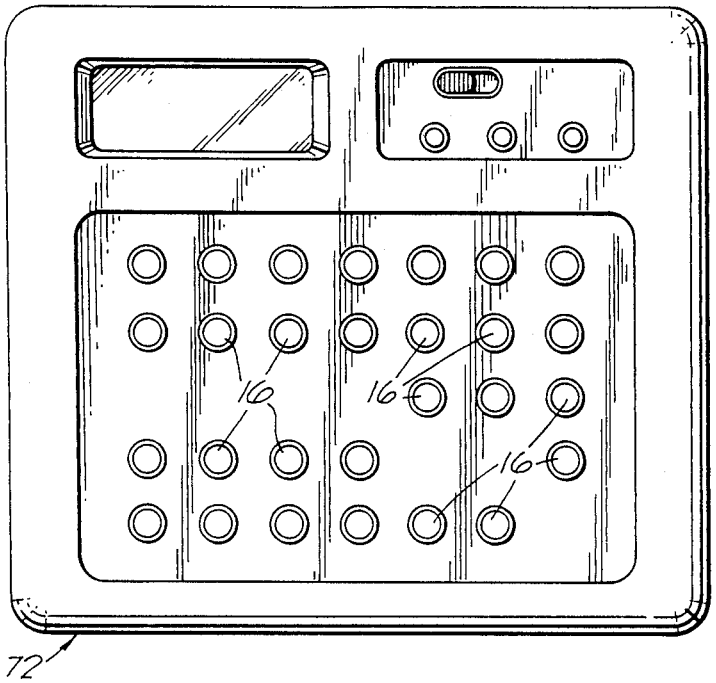
Fig. 6.
Fig. 7.
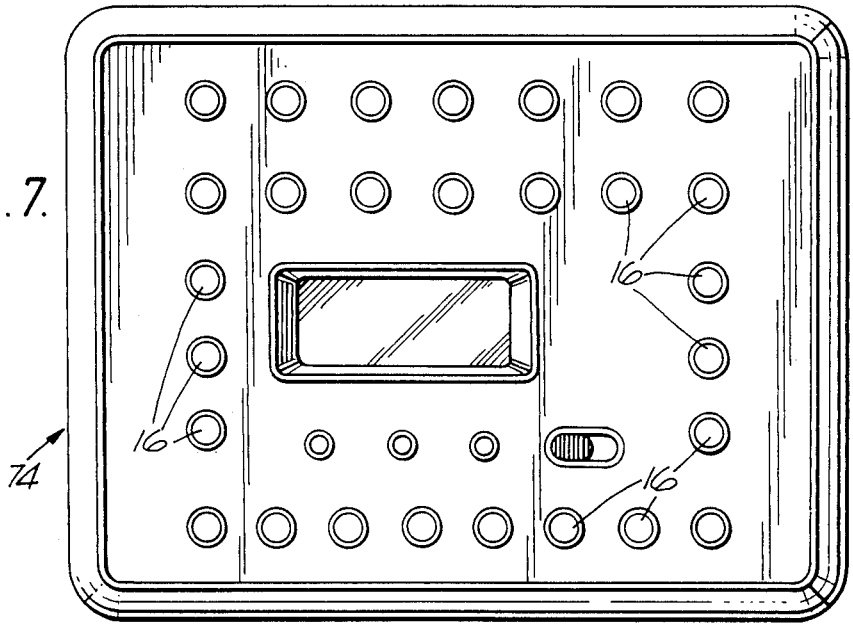

ALARM DEVICES

This invention relates to an alarm device for reminding users of the need to take medication of some form at a regular time. In particular, the device is suitable for reminding users to take pills like contraceptive pills.

BACKGROUND TO THE INVENTION

Various forms of electronic pill dispenser are known. However, these generally comprise some form of a container for a group of pills with an alarm which reminds the user to take one pill from within the container at regular intervals. The arrangement does, however, require the pills to be marketed in a loose and non-packaged form and equally all pills must be identical. Thus it is not possible to have pills of different properties as is often the case with a package of contraceptive pills where the pills need to be taken in a particular sequence.

It is therefore an object to the present invention to provide an improved device of this nature which can be emminently suitable for dispensing contraceptive pills or other pills which are marketed in the form of a package with individual compartments for individual pills.

BRIEF SUMMARY OF THE INVENTION

According to the invention, there is provided an alarm device for reminding the user to take an individually packaged medicament, comprising a support for a package of individually packaged pills, a number of individually depressible buttons each aligned with one individual compartment of the packet, whereby depression of a button will eject an individually packaged pill, timer means for monitoring the time elapsed since one button has been depressed, means linking the buttons to the timer means whereby depression of any one button will re-start the timer means at the same time as a pill is dispensed, and an audible alarm which sounds when the timer means reach a pre-selected period of time.

With such an arrangement, it is possible to dispense an individual pill from an already existing packet and the user can therefore follow the normal sequence of pills to be dispensed from the packet by simply pressing the appropriate button super-imposed over the individual pill. No change therefore is required in the packaging of the items and this is obviously an important advantage since contraceptives as an example already widely exist in various forms of conventional packaging and it would not be realistic to expect changes in that packaging to be made to suit the alarm device.

Although different packages of contraceptives or other medicaments like heart pills or diabetic pills are packaged by different companies indifferent formats, it is possible for the designer of an alarm device according to the invention to arrange for the disposition of the buttons in an individual unit to match any particular form of package. Also, by the very nature of the medicament, a user will generally consistently use one brand and so will choose to purchase an alarm device which suits his or her particular brand and will not need to have a series of alarm devices with buttons positioned in different places to suit all brands of medicament.

According to one preferred embodiment of the invention, only a single button remains depressed at any particular time. Thus, depression of a subsequent button desirably releases any previously depressed buttons. In this way, the user can very quickly see from noting which button is depressed which was the last pill. This is particularly convenient with items like contraceptives where it is often important to ingest the pills in a particular sequence.

As far as the use of the alarm device of the invention with contraceptive pills is concerned, it is normal for a cycle of 21 pills to be taken over a period of 21 days followed by a period of 7 days with no pills. There are dangers therefore in that the woman taking the pill can forget her regular daily routine of taking the pills during this period of 7 days. According to an advantageous feature of the invention therefore, a number of additional buttons are provided which will not be aligned with any compartment in the package containing the pills but which enable the woman to continue her regular routine of acknowledging the alarm every 24 hours. For example, there will normally be 7 buttons not aligned with any pill compartment for the period when no pills are to be taken but the woman who uses the alarm device would still need to acknowledge the alarm daily at her regular routine time for taking the pill on those days when no pill is to be ingested. This helps to assist in maintaining a regular routine and to ensure that the precise period of 7 days elapses between starting a cycle of pills.

According to one preferred feature of the invention, the timer means and the audible alarm consists of a conventional electronic timing module such as exists in a watch or other form of small time-keeping device. Preferably this also includes a display such as a liquid crystal display to show time. The audible alarm can then conveniently be the conventional 24 hour repeating alarm which is provided in many of such watch and like modules. However, whilst the 24 hour alarm is highly convenient for dispensing for example contraceptive pills, this may not be appropriate for other forms of medicaments such as heart pills or diabetic pills and, if appropriate therefore, the repetition period for the alarm need not be 24 hours.

The means for linking the timer and alarm means with the buttons can comprise a slidably mounted plate through which all of the buttons pass. This slidably mounted plate is mounted parallel to the card carrying the pills and has apertures in alignment with the buttons and through which the buttons pass. Cam means are provided on each button to displace the plate sideways when an individual button is depressed. For example, the cam means on the buttons can comprise an inclined wedge-shaped projection which displaces the plate sideways relative to the depression of the button against a spring or other resilient means as the button is depressed. Thus the button is depressed sufficiently to expel a pill from a compartment underneath it, the wedge-shaped projection will pass through the plate and the resilient means will return it to its non-displaced position so that the wedge-shaped cam means become trapped by the plate and hold that button depressed. Additionally, this displacement of the plate will release the wedge-shaped aperture of any previously depressed button. Further, means are provided on the plate for re-starting the timer means whenever the plate is displaced.

DESCRIPTION OF THE DRAWINGS

The invention will now be described, by way of example, with reference to the accompanying drawings, in which:

FIG. 3 is a section taken along the line 3—3 of FIG. 1;

FIG. 4 is an enlarged plan detail of part of the alarm device with the front case removed;

FIG. 6 is a plan view similar to FIG. 1 but of a modified alarm device according to the invention; and FIG. 7 is a plan view similar to FIG. 1 but of a further modified alarm device according to the invention.

DESCRIPTION OF THE PREFERRED EMBODIMENTS

Figure 1:
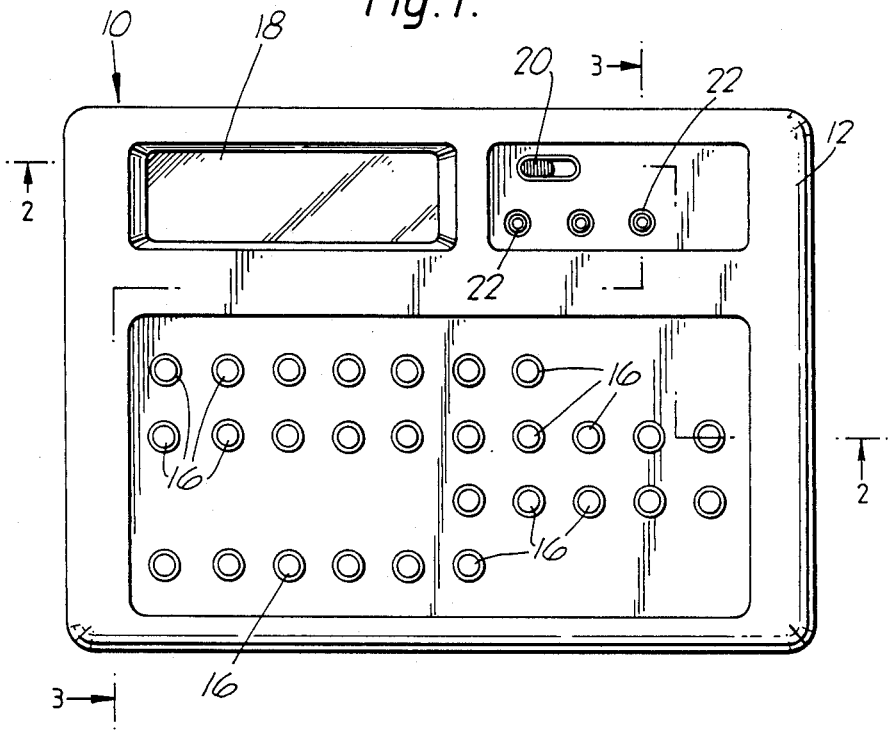
FIG. 1 is a plan view of one embodiment of an alarm device according to the invention.
Figure 2:
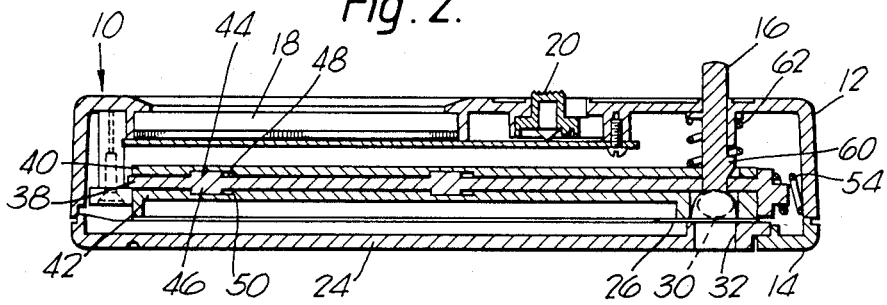
FIG. 2 is a section taken along the line 2—2 of FIG. 1.

Referring to FIGS. 1 to 3, the alarm device 10 according to the invention includes an outer casing composed of a front portion 12 and a rear portion 14. Extending upwardly from the front portion are a series of push buttons 16. The particular arrangement of these buttons and their operation will be described in due course.

In addition, a liquid crystal display 18 is visible through the front casing to show the time and conventional controls including an on-off slide switch 20 and push button 22 for time and alarm setting purposes are also provided.

The operation of the liquid crystal display 18 and of the associated electronic timing components will not be described in any further detail since these are entirely conventional components. They do, however, associated with them an audible alarm (not shown) which again can be entirely conventional.

As best shown on FIGS. 2 and 3, the rear housing 14 also includes a removeable plate 24. This plate is removed when it is desirable to add a fresh package 26 of contraceptives and then the plate 24 is replaced to hold the package 26 in position. This plate has a number of openings 32 (FIG. 2) in alignment with each of the individually packaged pills 30 in the package 26 so that individually pills can be dispensed through an appropriate aligned opening.

Additionally, the push button 16 are aligned so that one button is aligned with each individually packaged pill. Therefore, upon depression of a button, this will contact the covering 34 (see FIG. 6) containing the pill and continued depression of the button will press the packaging down against the pill which will then press against the bottom card material 36 of its compartment which is arranged to burst open and allow the pill to exit through an appropriate aperture 32. This method of dispensing pills from contraceptives packages and the like is extremely well known in that normally it is the user's finger which presses the top of the pack rather than the button.

Positioned above the packages 26 and within the casing is slidable plate 38. This is sandwiched between upper and lower stationary plates 40 and 42 fixed in the casing. Also the sliding plate has integral upwardly and downwardly projecting pins 44 and 46 which respectively engage in slots 48 and 50. This guide the plate 38 so that it is slidable transversely in the direction of the arrows 52, FIG. 4. It is slidable to the right against the resilient action of two springs 54 which urge it to the left in the sense seen in FIG. 4.

The plate 38 has a series of elongated holes 56, each in alignment with an appropriate one of the buttons 16, and the lower ends of the buttons, as best shown in FIG. 6, extend into these openings.

It will be noted, however, that seven of the buttons, namely, the top row of seven shown in FIG. 1, are not aligned with any compartment in the package or indeed with the package 26. The reason for this is that these buttons correspond to the seven days when no actual pill is to be taken during the contraceptive cycle but the alarm device 10 aims to give the user to the conventional routine reminder so as to ensure that the regular routine is kept. Also a count of the days when no pill is to be taken is also accurately kept so that the user knows precisely when to start a new package of contraceptives and the new cycle.

As best shown in FIG. 6, each button 16 also includes an integral wedge-shaped cam 60 extending out from its side. Also each button has its own associated spring 62 tending to urge the button upwardly. The cams 60 are arranged to contact the edge of the respective elongated opening 56 in the plate 38 as the button is depressed, so moving the plate to the right in the sense shown in FIGS. 4 and 5. Once the button has been depressed sufficiently, however, for the wedge-shaped cam to penetrate completely through the elongated opening 56 in the sliding plate, then the plate can snap back under the effect of the springs 54 towards the left behind the button. This has the effect therefore, of retaining the button in its depressed position against the resilient action of the spring 62 tending to urge the button to its outer position.

The button is therefore retained in a depressed position until a further button is depressed which will cause the plate to move to the right and, as the plate is indeed moved to the right in the sense shown in FIG. 4 when a further button is depressed, then a point will be reached where an already depressed button will no longer be retained by the engagement of the end of the cam 60 underneath the plate but will be released simultaneously with the depression of the other button.

The buttons are retained within the front casing by means of an annular flange 66 which engages the underneath of the front housing 12.

Figure 5:
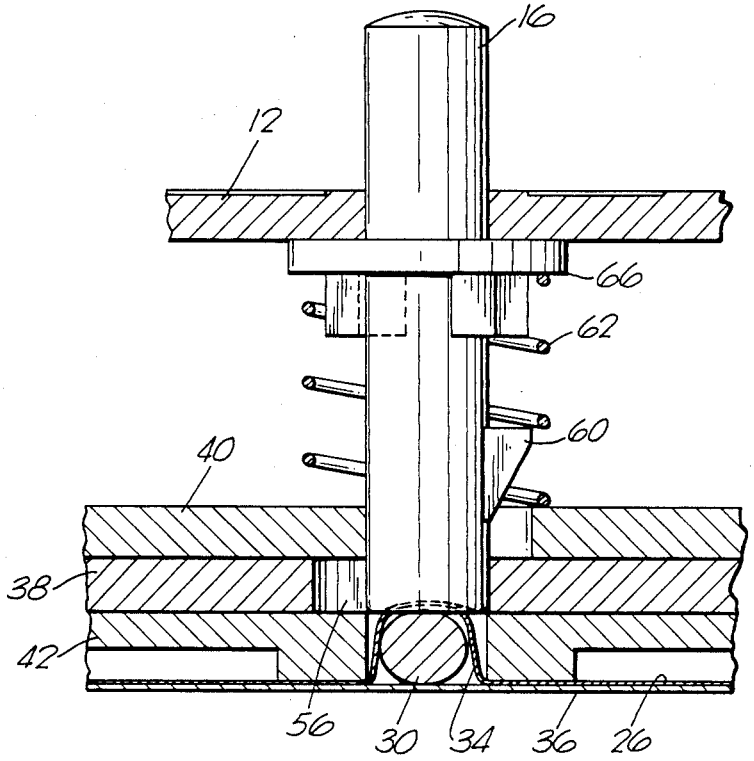
FIG. 5 is an enlarged sectional detail showing the operation of one of the push buttons.

As best shown in FIGS. 4 and 5, the sliding plate has an integral projection 68 at its upper end which engages with a switch means 70 associated with the timer and alarm. As the plate 38 slides under the effect of depression of one of the buttons 16, this projection 68 slides across the face of a printed circuit board 70 (FIG. 3) carrying the time keeping components and completes the circuit between two exposed conductors on the board so resetting the alarm for a further 24 hours.

Contraceptive manufacturers market their packages in different formats and therefore the alarm device 10 shown in FIG. 1 is suitable only for use with one format. In the modified alarm devices 72 and 74 shown in FIGS. 7 and 8, the components are substantially identical but the arrangement of the push buttons 16 differs to suit the arrangements of other manufacturers. It will be appreciated that many other different arrangements are possible and may be necessary to suit other manufacturers' packaging arrangements but this is a matter of simple choice in the arrangement of the push buttons and perforations in the sliding plate 38.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

I claim:

1. An alarm device for reminding a user to take an individually packaged pill from a package of individually packaged pills, each of said pills being packaged in an individual compartment of said package, comprising:

a support for holding said package;

a number of buttons mounted to said support, each said button aligned with a compartment of said package and being depressable into a retained position to eject a package pill from said aligned compartment;

slidable actuating means mounted to said support and displaceable with respect to said support in response to depression of any one of said buttons into its retained position;

a timer for monitoring elapsed time after a push-button has been depressed, said timer being actuated upon displacement of said slidable actuating means with respect to said support; and an alarm operatively associated with said timer to indicate when elapsed time reaches a preselected duration.

2. An alarm device according to claim 1 in which said depressed button remains in its retained position until the subsequent depression of an undepressed button, said subsequent depression releasing any previously depressed buttons.

3. An alarm device according to claim 1 in which a number of additional buttons are provided, each said additional button being depressable into a retained position to displace said slidable actuating means, but not being aligned with a pill containing compartment, thereby to enable a regular routine of acknowledging the alarm to be kept even if for some period no pill is to be taken.

4. The alarm device of claim 1 wherein said displacement of said slidable actuating means directly actuates said timer.

5. An alarm device for reminding a user to take an individually packaged pill from a package of individually packaged pills, each of said pills being packaged in an individual compartment of said package, comprising:

a support for holding said package;

a number of buttons mounted to said support, each said button being aligned with a compartment of said package and being depressable into a retained position to eject a pill from said aligned compartment, each said button further having a cam means associated therewith;

a slidable plate mounted to said support, said plate having holes through which said buttons extend whereby said cam means associated with said depressed button displaces said plate sideways upon depression of any one of said buttons into a retained position;

a timer for monitoring time elapsed after a button has been depressed, said timer being actuated by said sideways displacement of said plate; and an alarm operatively associated with said timer to indicate when elapsed time reaches a preselected period of time.

6. The alarm device of claim 5 wherein said displacement of said slidable plate directly actuates said timer.

* * * * *